US007448511B2

(12) United States Patent
Schippl

(10) Patent No.: US 7,448,511 B2
(45) Date of Patent: Nov. 11, 2008

(54) DOUBLE-WALL TANK

(75) Inventor: Klaus Schippl, Hannover (DE)

(73) Assignee: Nexans, Paris (FR)

( * ) Notice: Subject to any disclaimer, the term of this patent is extended or adjusted under 35 U.S.C. 154(b) by 262 days.

(21) Appl. No.: 11/016,538

(22) Filed: Dec. 17, 2004

(65) Prior Publication Data

US 2005/0211710 A1 Sep. 29, 2005

(30) Foreign Application Priority Data

Mar. 1, 2004 (EP) ..... 04290556

(51) Int. Cl.
*F17C 1/00* (2006.01)
*F17C 3/08* (2006.01)
*H01F 6/06* (2006.01)

(52) U.S. Cl. ..... 220/560.04; 62/45.1; 505/163

(58) Field of Classification Search ..... 220/560.04, 220/560.12, 592.27; 62/45.1, 51.1, 51.3; 505/163, 212

See application file for complete search history.

(56) References Cited

U.S. PATENT DOCUMENTS 2,864,591 A * 12/1958 Frink ..... 165/177
3,358,463 A * 12/1967 Hawkins et al. ..... 62/51.1
3,938,346 A * 2/1976 Ovchinnikov et al. ..... 62/47.1
3,948,409 A * 4/1976 Ovchinnikov et al. .. 220/560.12
4,496,073 A * 1/1985 Silver et al. ..... 220/560.11
4,510,771 A * 4/1985 Matsuda et al. ..... 62/51.1
4,986,078 A * 1/1991 Laskaris ..... 62/51.1
6,998,947 B2 * 2/2006 Penn et al. ..... 335/216

FOREIGN PATENT DOCUMENTS

DE 4418745 C2 * 12/1996

* cited by examiner

*Primary Examiner*—Anthony D Stashick
*Assistant Examiner*—Shawn M Braden
(74) *Attorney, Agent, or Firm*—Sofer & Haroun, LLP

(57) ABSTRACT

A double-wall tank for storing and shipping cryogenic media, which consists of an inner tank that contains the medium, an outer casing spaced some distance from the inner tank, and an evacuated space located between the inner tank and the outer casing, such that at least one permanent magnet is installed in the evacuated space and is arranged opposite a high-temperature superconductor, so that the inner tank is supported in the casing without contact, has the following features:

the high-temperature superconductor (8) is located in the evacuated space (5), both the inner tank (1) and the casing (2) have a neck (3, 4), and the necks (3, 4) are arranged concentrically to each other, the neck (3) of the inner tank (1) is a spirally corrugated metal tube (3), whose outer end is attached to the neck (4) of the casing (2).

6 Claims, 2 Drawing Sheets

DOUBLE-WALL TANK

RELATED APPLICATION

This application is related to and claims the benefit of priority from European Patent Application No. 04 290 556.2, filed on Mar. 1, 2004, the entirety of which is incorporated herein by reference.

The invention concerns a double-wall tank in accordance with introductory clause of Claim 1.

Tanks for low-boiling, liquefied gases are always provided with expensive insulation to minimize evaporation of the liquefied gas by absorption of heat from the environment. Therefore, they are designed as double-wall tanks, in which an inner tank that holds the liquefied gas is supported in an outer tank that is exposed to the ambient temperature, and a layer of insulation is provided between the inner tank and the outer tank.

The insulation consists of a material that is a poor thermal conductor, such as superinsulation. After completion of the tank, the space between the inner and outer tanks is evacuated.

The cold inner tank is connected with the outer tank by mechanical suspension or support elements. Connections of this sort are essential for absorbing the forces that act on the inner tank by the tank's own weight and operating stresses. Consequently, the connections must possess sufficient mechanical strength and rigidity and thus necessarily lead to the absorption of heat by solid-body heat conduction.

This has special consequences in motor vehicle tanks for new cryogenic fuels. In these tanks, due to the necessity of optimum utilization of the available tank space, the insulation gap between the inner tank and the outer tank must be kept as small as possible. In a conventional tank suspension, this results in short support elements with comparatively high heat absorption and thus limited service life.

DE 44 18 745 C2 describes a double-wall tank for storing low-boiling, liquefied gases with an inner tank that holds the liquefied gas and an outer tank that supports the inner tank. The inner tank is supported without contact with the outer tank by superconductors located in the liquefied gas and by permanent magnets installed on the outer tank. The superconductors are type II ceramic superconductors, such as YBCO 123 or BSCCU 2212, whose critical temperature Tc is above the temperature of the low-boiling liquefied gas.

A tubular line, which passes through the walls of the outer tank and the inner tank, is provided for filling the inner tank with liquefied gas or for removing gas. This solution cannot be used for small tanks from which the liquefied gas is removed by pouring.

The objective of the present invention is to develop a double-wall tank for liquefied gases, which can be easily operated and in which the heat losses can be reduced, especially in the area of the outlet, and the storage time of the liquefied gas can thus be increased.

The chief advantages of the invention are:

automatic activation of the suspended state is achieved by flexible mounting in the area of the outlet, and heat losses in the area of the outlet are reduced by the use of the spirally corrugated metal tube. As a result of a non-metallic plug, the cold evaporated gas is carried along in the flow channel that runs spirally around the outlet and is heated in it until it emerges from the outlet. In this way, the heat content of the cold gas is fully utilized, and heat flow into the interior of the tank through the outlet is reduced.

The invention is explained in greater detail with reference to the specific embodiment shown schematically in FIGS. 1 and 2.

Figure 1:
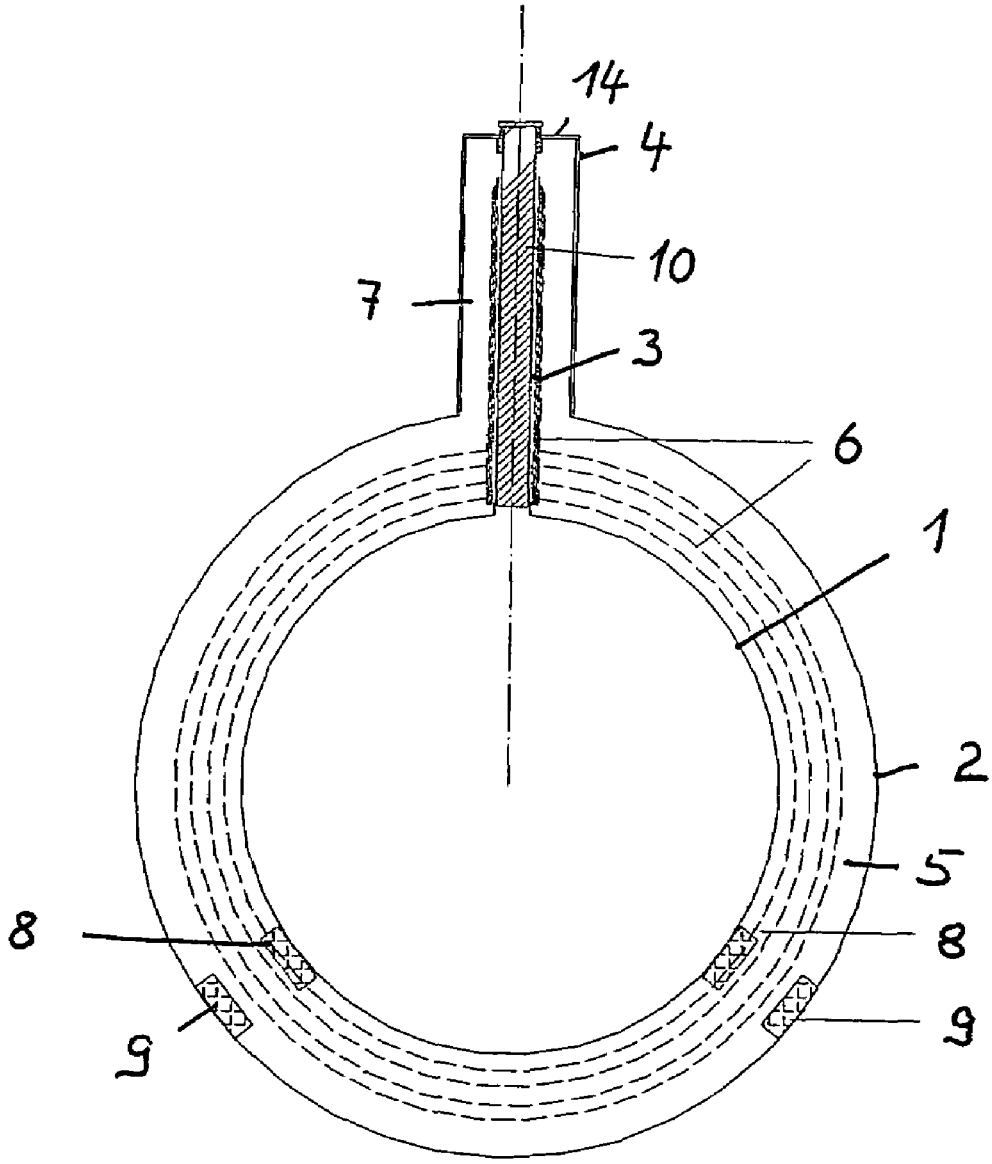
FIG. 1 shows a cross section of a tank in accordance with the teaching of the invention.

The tank consists of an inner tank 1, which contains the medium, and an outer casing 2 that surrounds the inner tank 1.

The tank 1 and the casing 2 are spherical in shape and consist of two hemispherical shells. However, other designs are possible.

The hemispherical shells suitably consist of austenitic steel and are joined by a weld.

A thin-walled corrugated metal tube 3 is welded onto the inner tank 1 and is used as a filling and delivery device.

A nozzle 4 is installed on the outer casing 2 concentrically to the metal tube 3 and is also welded with the outer casing 2.

The space 5 between the inner tank 1 and the outer casing 2 is filled with several layers 6 of superinsulation and is evacuated. The annulur space 7 between the metal tube 3 and the nozzle 4 also has several layers of superinsulation. The evacuated space 5 is sealed from the outside by a ring disk 14.

Two high-temperature superconductors 8 are mounted on the inner tank 1. Two permanent magnets 9 are mounted on the outer casing 2 opposite the high-temperature superconductors 8. The high-temperature superconductors 8 and the permanent magnets 9 support the inner tank 1 in the outer casing 2 without contact.

The metal tube 3 contains a plug 10 made of an insulating material, e.g., plastic, whose diameter is almost the same as the inside diameter of the metal tube 3, so that the interior of the inner tank 1 communicates with the external environment through a spiral channel 11 (see FIG. 2), through which the evaporated cold gas can emerge. This allows full utilization of the heat content of the cold gas and reduction of the heat flow through the metal tube 3 into the interior of the tank 1.

Figure 2:
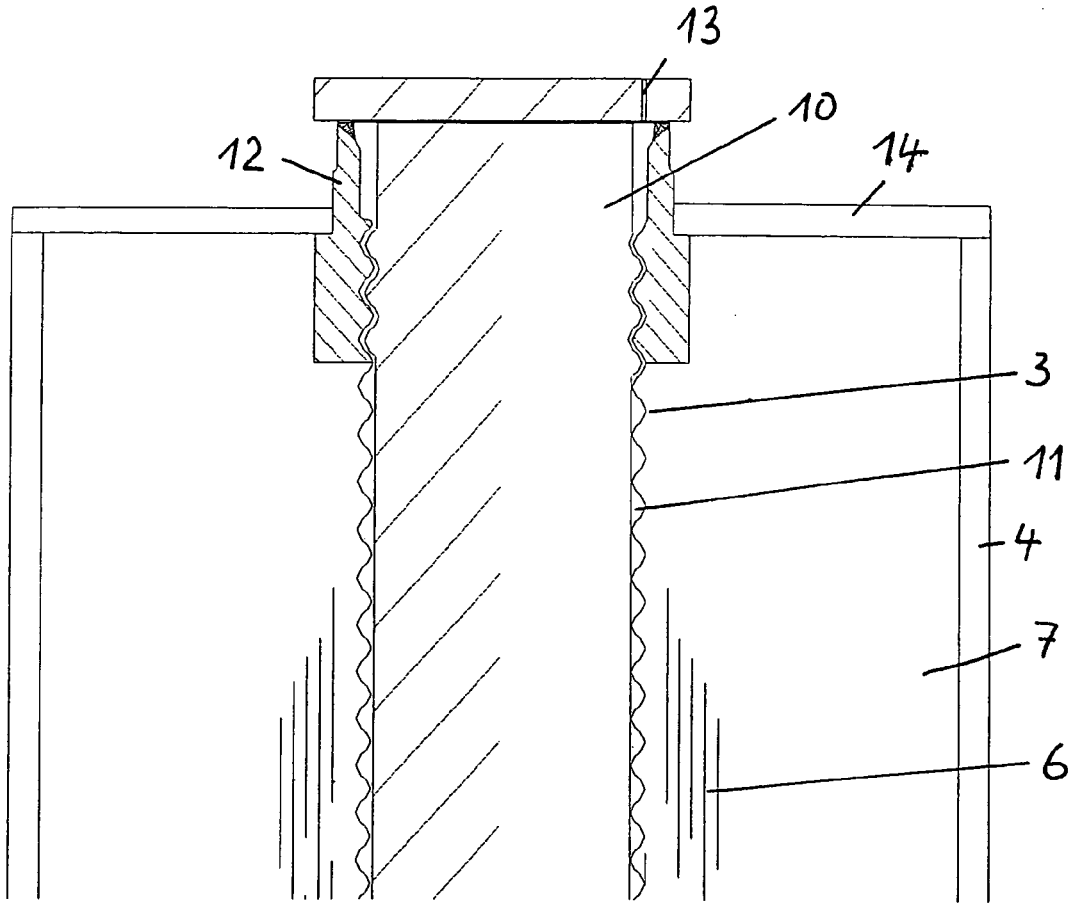
FIG. 2 shows an enlarged cross section of the outlet of the tank of the invention.

As is shown in the enlarged view in FIG. 2, the evacuated space is sealed by the ring disk 14, which is welded gastight with the nozzle 4 and with a bushing 12, which is screwed onto the end of the metal tube 3. The end of the metal tube 3 is also welded with the bushing 12. The cold gas emerging from inside the tank 1 can escape into the atmosphere through an outlet 13. To reduce the absorption of external heat by the tank 1 as much as possible, the wall thickness of the metal tube 3 is kept as small as possible. The metal tube 3 is thus produced from a sheet of stainless steel by longitudinal welding and subsequent corrugation. Its wall thickness is 0.1-0.5 mm. The length of the metal tube 3 is 30-200 mm, and its outside diameter is between 2-80 mm.

The metal tube 3 has very low thermal conductivity due to its low wall thickness and due to the use of stainless steel as the material. The corrugation of the metal tube 3 results in the further advantage that the metal tube 3 has a great deal of flexibility and greater transverse rigidity than a smooth metal tube. Furthermore, the corrugated metal tube 3 is "longer" than a smooth metal tube, since more metal strip is required. The greater "length" results in further reduction of the thermal conductivity. The tank in accordance with the teaching of the invention is suitable especially for liquefied gases. Compared to tanks that are presently commercially available, it increases liquefied gas storage time by a large factor.

The invention claimed is:

1. Double-wall tank for storing and shipping cryogenic media, comprising:

an inner tank that contains the medium;

an outer casing spaced some distance from the inner tank;

an evacuated space located between the inner tank and the outer casing, such that at least one permanent magnet is installed in the evacuated space and is arranged opposite a high-temperature superconductor, so that the inner tank is supported in the casing without contact, wherein the high-temperature superconductor is located in the evacuated space, both the inner tank and the casing have a neck, and the necks are arranged concentrically to each other, and the neck of the inner tank is a helically corrugated metal tube, whose outer end is attached to the neck of the casing; and a plug made of a nonmetallic material is located inside the corrugated metal tube wherein the plug fills the inside cross section of the corrugated metal tube, so that a spiral channel is formed between the corrugated tube and the plug.

2. Tank in accordance with claim 1, wherein the permanent magnet is mounted on the casing, and the superconductor is mounted on the inner tank.

3. Tank in accordance with claim 1 wherein the evacuated space contains several layers of a superinsulation material.

4. Tank in accordance with claim 1, wherein the corrugated tube has a wall thickness of 0.1-0.5 mm.

5. Tank in accordance with claim 1, wherein two or more permanent magnets and high-temperature superconductors are installed in the evacuated space and are uniformly distributed in the lower part of the tank at an angle of 0-90° from the vertical.

6. Double-wall tank for storing and shipping cryogenic media, comprising:

an inner tank that contains the medium;

an outer casing spaced some distance from the inner tank;

an evacuated space located between the inner tank and the outer casing, such that at least one permanent magnet is installed in the evacuated space and is arranged opposite a high-temperature superconductor also located in the same evacuated space, so that the inner tank is supported in the casing without contact allowing said double-walled tank to be formed with a small special dimension, allowing for removal of a liquefied gas, used to cool said cryogenic media, by pouring, both the inner tank and the casing have a neck, and the necks are arranged concentrically to each other, and the neck of the inner tank is a helically corrugated metal tube, whose outer end is attached to the neck of the casing; and a plug made of a nonmetallic material is located inside the corrugated metal tube wherein the plug fills the inside cross section of the corrugated metal tube, so that a spiral channel is formed between the corrugated tube and the plug.

* * * * *